US011165146B2

(12) United States Patent
Sutar

(10) Patent No.: US 11,165,146 B2
(45) Date of Patent: Nov. 2, 2021

(54) BASE STATION ANTENNA RADOMES WITH NON-UNIFORM WALL THICKNESS

(71) Applicant: CommScope Technologies LLC, Hickory, NC (US)

(72) Inventor: Yateen Sutar, Vasco da Gama (IN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/545,296

(22) Filed: Aug. 20, 2019

(65) Prior Publication Data

US 2020/0076068 A1 Mar. 5, 2020

Related U.S. Application Data

(60) Provisional application No. 62/723,570, filed on Aug. 28, 2018.

(51) Int. Cl.
*H01Q 1/42* (2006.01)
*H01Q 1/24* (2006.01)

(52) U.S. Cl.
CPC ..... *H01Q 1/42* (2013.01); *H01Q 1/246* (2013.01)

(58) Field of Classification Search
CPC ..... H01Q 1/40; H01Q 1/405; H01Q 1/42; H01Q 1/246
See application file for complete search history.

(56) References Cited

U.S. PATENT DOCUMENTS

| | | | | |
|---|---|---|---|---|
| 5,990,835 | A * | 11/1999 | Kuntzsch | H01Q 1/24 343/700 MS |
| 6,184,842 | B1 * | 2/2001 | Leinweber | B29C 45/16 343/872 |
| 2010/0039346 | A1 * | 2/2010 | Peter | H01Q 21/06 343/872 |
| 2014/0111396 | A1 * | 4/2014 | Hyjazie | H01Q 1/52 343/798 |
| 2015/0130672 | A1 * | 5/2015 | Cordone | H01Q 1/28 343/705 |
| 2017/0040679 | A1 * | 2/2017 | Frohler | H01Q 1/246 |
| 2017/0222313 | A1 * | 8/2017 | Markof | H01Q 21/26 |
| 2018/0040948 | A1 * | 2/2018 | Gottl | H01Q 1/246 |
| 2018/0159207 | A1 * | 6/2018 | Shurish | H01Q 1/422 |
| 2018/0159211 | A1 * | 6/2018 | Biancotto | H01Q 19/18 |
| 2018/0337443 | A1 * | 11/2018 | Bisiules | H01Q 1/42 |
| 2020/0262958 | A1 * | 8/2020 | Takahashi | C08F 287/00 |
| 2021/0075092 | A1 * | 3/2021 | Su | H01Q 15/14 |

FOREIGN PATENT DOCUMENTS

WO 2017165512 9/2017

* cited by examiner

*Primary Examiner* — Jason Crawford
(74) *Attorney, Agent, or Firm* — Myers Bigel, P.A.

(57) ABSTRACT

Radomes of base station antennas are provided herein. A radome of a base station antenna includes a non-uniformly thick perimeter wall. In some embodiments, the radome is a non-glass radome, and an interior surface of the non-uniformly thick perimeter wall includes a plurality of built-in solid support ridges. Related base station antennas are also provided.

19 Claims, 3 Drawing Sheets

BASE STATION ANTENNA RADOMES WITH NON-UNIFORM WALL THICKNESS

CROSS-REFERENCE TO RELATED APPLICATION

The present application claims priority to U.S. Provisional Patent Application No. 62/723,570, filed Aug. 28, 2018, the entire content of which is incorporated herein by reference.

FIELD

The present disclosure relates to communication systems and, in particular, to radomes for base station antennas.

BACKGROUND

Base station antennas for wireless communication systems are used to transmit Radio Frequency (RF) signals to, and receive RF signals from, fixed and mobile users of a cellular communications service. Base station antennas often include a linear array or a two-dimensional array of radiating elements such as dipole, or crossed dipole, radiating elements.

Example base station antennas are discussed in International Publication No. WO 2017/165512 to Bisiules and U.S. patent application Ser. No. 15/921,694 to Bisiules et al., the disclosures of which are hereby incorporated herein by reference in their entireties. Some base station antennas, however, have structural weaknesses. Moreover, attempts to overcome structural weaknesses can result in base station antennas that are expensive, heavy, and/or aesthetically undesirable.

SUMMARY

A base station antenna, according to some embodiments herein, may include a radiating element. Moreover, the base station antenna may include a radome that includes a non-uniformly thick perimeter wall around the radiating element. The non-uniformly thick perimeter wall may include a protruding portion that is thicker than an adjacent flat portion of the non-uniformly thick perimeter wall.

In some embodiments, the protruding portion may protrude toward the radiating element. Moreover, the radome may be a plastic radome, and the protruding portion may be one among a plurality of protruding portions of the non-uniformly thick perimeter wall. The plurality of protruding portions may be a plurality of built-in solid ribbed supports, respectively. The base station antenna may include a radome support that abuts an interior surface of the non-uniformly thick perimeter wall, and the interior surface may include the plurality of built-in solid ribbed supports.

According to some embodiments, the radiating element may be one among a plurality of radiating elements in the radome. Additionally or alternatively, the radome may be a plastic radome, the flat portion may have a first thickness of 2.3-2.5 millimeters (mm), and the protruding portion may have a second thickness of 5 mm or thinner that is thicker than the first thickness. The protruding portion may have a transverse cross-section that has an elliptical shape that has a radius of 25 mm or smaller that is perpendicular to the second thickness.

A radome of a base station antenna, according to some embodiments herein, may include a non-uniformly thick perimeter wall. The non-uniformly thick perimeter wall may include first and second surfaces that face each other. Moreover, the non-uniformly thick perimeter wall may include third and fourth surfaces that face each other and that connect the first and second surfaces to each other. The non-uniformly thick perimeter wall may increase in thickness at intersections of the third and fourth surfaces with the first and second surfaces.

In some embodiments, the intersections of the third and fourth surfaces with the first and second surfaces may include respective curved portions of the non-uniformly thick perimeter wall. Additionally or alternatively, the non-uniformly thick perimeter wall may increase in thickness at a midpoint of the first surface, the second surface, third surface, or the fourth surface. Moreover, the non-uniformly thick perimeter wall may increase in thickness at a point that is between the midpoint and one of the intersections.

According to some embodiments, the radome may be a plastic radome, flat portions of the first, second, third, and fourth surfaces may have respective first thicknesses of 2.3-2.5 mm, and the intersections of the third and fourth surfaces with the first and second surfaces may have respective second thicknesses of 5 mm or thinner that are thicker than the first thicknesses. Moreover, the intersections of the third and fourth surfaces with the first and second surfaces may include respective elliptical shapes having radii of 25 mm or smaller that are perpendicular to the respective second thicknesses.

A non-glass radome of a base station antenna, according to some embodiments herein, may include an interior surface that includes a plurality of built-in solid support ridges. Ones of the plurality of built-in solid support ridges that are at corner regions of the interior surface may protrude only inwardly toward a cavity inside the non-glass radome. The non-glass radome may be a plastic radome. For example, the plastic radome may be a polyvinyl chloride (PVC) radome.

In some embodiments, the non-glass radome may include an exterior surface that is opposite the interior surface. Moreover, first wall thicknesses, from first portions of the exterior surface to respective flat portions of the interior surface that are between the plurality of built-in solid support ridges, may be 2.3-2.5 mm, and second wall thicknesses, from second portions of the exterior surface to the plurality of built-in solid support ridges, respectively, may be thicker than the first wall thicknesses and may be 5 mm or thinner. The plurality of built-in solid support ridges may include a plurality of elliptical shapes, respectively, having radii of 25 mm or smaller that are perpendicular to the second wall thicknesses.

DETAILED DESCRIPTION

Pursuant to embodiments of the present inventive concepts, base station antennas radomes are provided. Radomes of base station antennas are typically made of fiberglass. Although radomes of base station antennas can also be made of extruded PVC, PVC is structurally weaker than fiberglass.

According to embodiments of the present inventive concepts, however, a radome of a base station antenna has a non-uniform perimeter wall thickness. In particular, the perimeter wall of the radome includes at least one portion, such as a ridge/rib shape, that is thicker than adjacent portions of the perimeter wall. The thick portion(s) of the perimeter wall provide structural support for the radome. In particular, the thick portion(s) increase the rigidity of the radome. For example, the thick portion(s) may be used to improve the rigidity of a PVC radome that otherwise would be structurally weak relative to a fiberglass radome.

Moreover, the thick portion(s) of the perimeter wall may comprise a solid structure rather than a hollow tube, as the solid structure may be more aesthetically desirable and/or simpler to manufacture. For example, whereas a hollow tube may include air therein, the solid structure is substantially free of air. The solid structure of the thick portion(s) may comprise the same material (e.g., PVC) as adjacent thin portions of the perimeter wall.

Example embodiments of the present inventive concepts will be described in greater detail with reference to the attached figures.

Figure 1A:
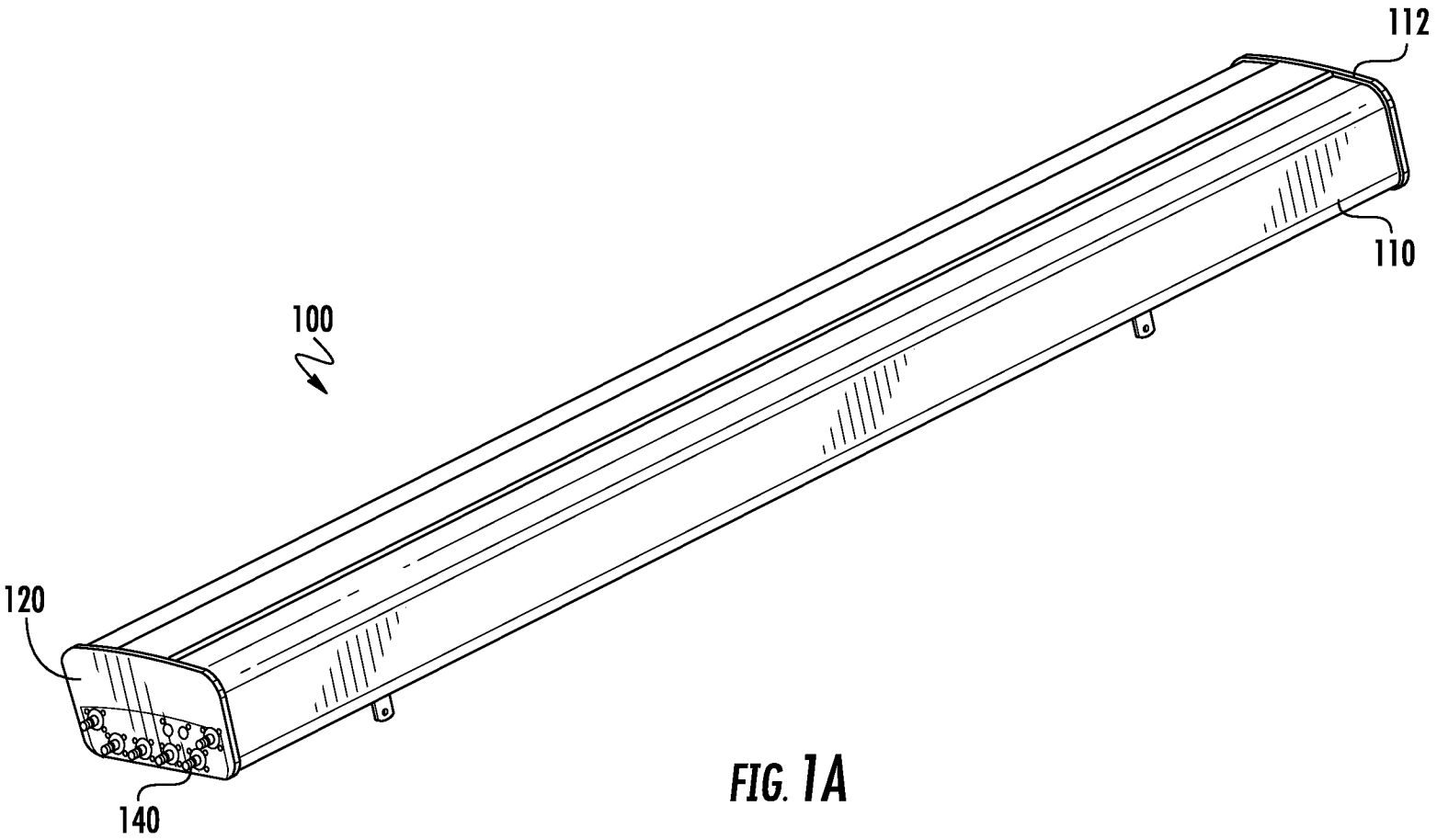
FIG. 1A is a front perspective view of a base station antenna according to embodiments of the present inventive concepts.

FIG. 1A is a front perspective view of a base station antenna 100 according to embodiments of the present inventive concepts. As shown in FIG. 1A, the base station antenna 100 is an elongated structure and has a generally rectangular shape. In some embodiments, the width and depth of the base station antenna 100 may be fixed, and the length of the base station antenna 100 may be variable. For example, the base station antenna 100 may have a width of 350 mm, a depth of 208 mm, and a variable length.

The base station antenna 100 includes a radome 110. In some embodiments, the base station antenna 100 further includes a top end cap 112 and/or a bottom end cap 120. For example, the radome 110, in combination with the top end cap 112 and/or the bottom end cap 120, may comprise a single unit, which may be helpful for waterproofing the base station antenna 100. The bottom end cap 120 may include a plurality of connectors 140 mounted therein.

In some embodiments, mounting brackets may be provided on the rear (i.e., back) side of the radome 110. The mounting brackets may be used to mount the base station antenna 100 onto an antenna mount that is on, for example, an antenna tower. The base station antenna 100 is typically mounted in a vertical configuration (i.e., the long side of the base station antenna 100 extends along a vertical axis with respect to Earth).

Figure 1B:
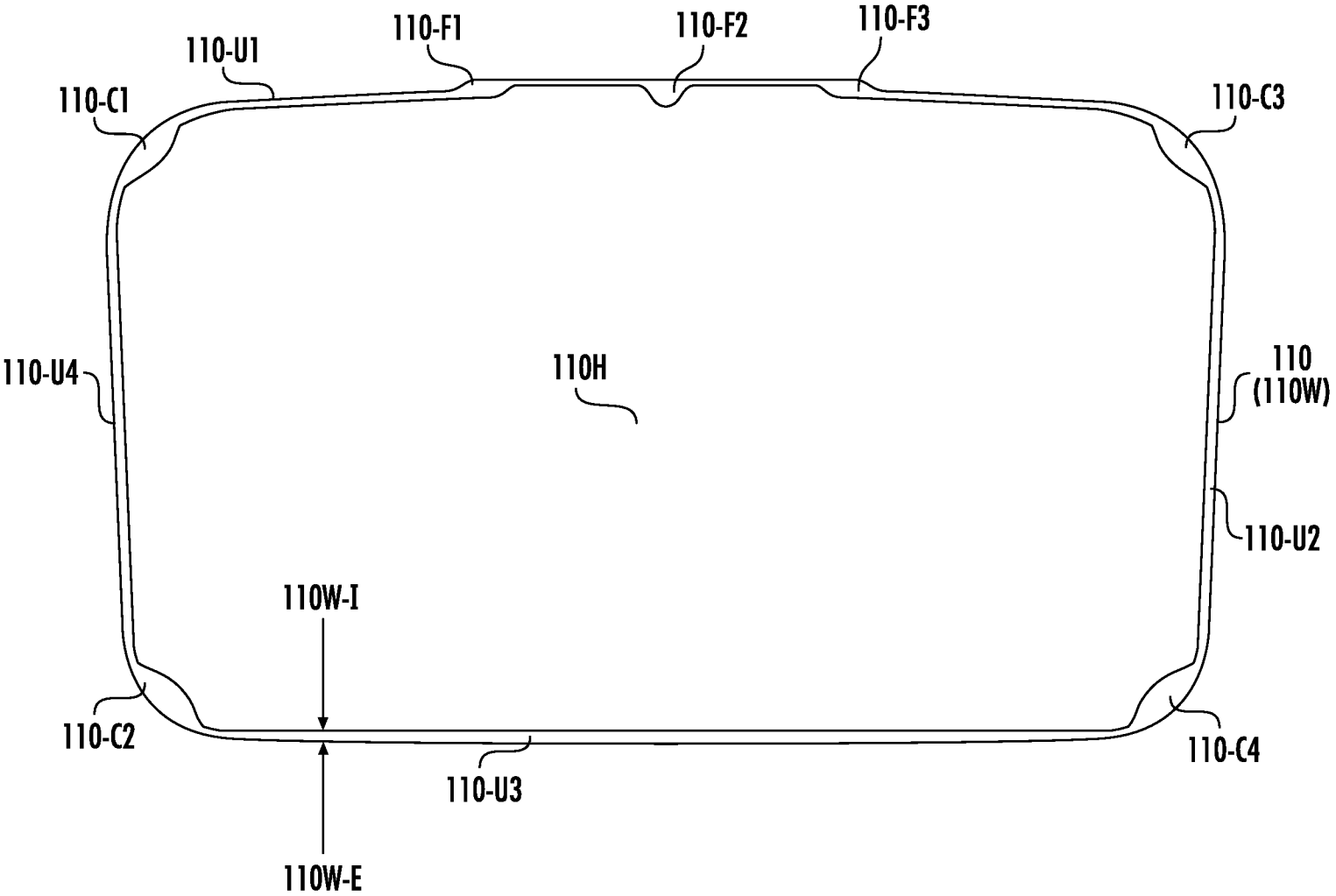
FIG. 1B is a profile view of a radome of a base station antenna according to embodiments of the present inventive concepts.

FIG. 1B is a profile view of a radome 110 of a base station antenna 100 according to embodiments of the present inventive concepts. In particular, the profile view shows a perimeter wall 110W of the radome 110. The perimeter wall 110W is non-uniformly thick. For example, the perimeter wall 110W may include thin portions 110-U (e.g., 110-U1, 110-U2, 110-U3, and 110-U4) that are substantially uniformly thick relative to each other and at least one thick portion 110-C/F (e.g., 110-C1, 110-C2, 110-C3, 110-C4, 110-F1, 110-F2, and/or 110-F3) that is substantially thicker than the thin portions 110-U. As an example, it may be advantageous for the perimeter wall 110W to include the thick portions 110-C1, 110-C2, 110-C3, and 110-C4, as they can improve rigidity in curved/corner regions of the perimeter wall 110W that may otherwise be relatively weak.

The thickness of a given portion of the perimeter wall 110W is the distance from an interior surface 110W-I of that portion of the perimeter wall 110W to an opposite, exterior surface 110W-E of that portion of the perimeter wall 110W. The respective thicknesses of the thin portions 110-U vary by no more than ten percent relative to each other, whereas the at least one thick portion 110-C/F is more than ten percent thicker than an adjacent one of the thin portions 110-U. As an example, the thin portions 110-U may be 2.3-2.5 mm (e.g., 2.4 mm) thick, and the at least one thick portion 110-C/F comprises a thickness of up to 5 mm. It may be desirable for the thicknesses of the thin and thick portions 110-U and 110-C/F of the perimeter wall 110W to not exceed 2.5 mm and 5 mm, respectively, as a relatively thin perimeter wall 110W can reduce the weight and cost of the radome 110. Also, if the at least one thick portion 110-C/F exceeds 5 mm in thickness, then manufacturing of the radome 110 may be more challenging and cooling of the base station antenna 100 may be adversely affected. In some embodiments, the majority of the perimeter wall 110W may comprise the thin portions 110-U and thus may have a thickness of 2.5 mm or thinner.

The thin portions 110-U may comprise flat portions of the perimeter wall 110W. The at least one thick portion 110-C/F, on the other hand, may protrude toward an interior of the base station antenna 100. As a result, the perimeter wall 110W is non-uniformly thick. In some embodiments, the thick portions 110-C that are at curved/corner regions of the perimeter wall 110W protrude only inwardly (and not outwardly). Moreover, in some embodiments, a protruding thick portion 110-C/F of the perimeter wall 110W may be curved, or otherwise non-uniformly thick. Accordingly, the thickest (e.g., center) region of the protruding thick portion 110-C/F may be up to 5 mm thick, and edge regions of the protruding thick portion 110-C/F may decrease in thickness as they approach adjacent flat thin portions 110-U of the perimeter wall 110W.

Moreover, the thin portions 110-U1 and 110-U3 may be part of respective sides/surfaces of the perimeter wall 110W that face each other. For example, the thin portion 110-U1 may be part of the front surface/side of the radome 110, and the thin portion 110-U3 may be part of the rear surface/side of the radome 110. Similarly, the thin portions 110-U2 and 110-U4 may be part of respective sides/surfaces of the perimeter wall 110W that face each other and that connect the front surface/side and the rear surface/side to each other.

In some embodiments, the perimeter wall 110W increases in thickness at intersections of these surfaces/sides. In particular, FIG. 1B illustrates an example in which the intersections of the surfaces/sides of the perimeter wall 110W comprise respective curved (or otherwise non-planar) portions of the perimeter wall 110W that are thicker than adjacent flat (i.e., planar) portions of the perimeter wall 110W. Specifically, the curved portions of the perimeter wall 110W comprise the thick portions 110-C1, 110-C2, 110-C3, and 110-C4. Accordingly, the intersections of the surfaces/sides of the perimeter wall 110W comprise respective thicknesses of up to 5 mm (i.e., non-zero thicknesses of 5 mm or thinner), whereas the adjacent flat thin portions 110-U of the perimeter wall 110W comprise respective thicknesses of 2.3-2.5 mm.

Additionally or alternatively, the perimeter wall 110W may increase in thickness at a midpoint/center of one of its sides/surfaces. For example, FIG. 1B illustrates an example in which the thick portion 110-F2 is at a midpoint/center of the front surface/side of the perimeter wall 110W. As the midpoint/center of the front surface/side may be a relatively weak portion of the radome 110, it may be desirable to strengthen this midpoint/center by including the thick portion 110-F2. Moreover, the perimeter wall 110W may increase in thickness at a point that is between the midpoint/center and an intersection of the front side/surface with another one of the sides/surfaces. As two examples, FIG. 1B illustrates the thick portions 110-F1 and 110-F3 that are offset from the midpoint/center of the front side/surface of the perimeter wall 110W.

The radome 110 provides the base station antenna 100 with a generally rectangular shape. For example, the thick portions 110-C1, 110-C2, 110-C3, and 110-C4 of the perimeter wall 110W may be at respective corners/vertices of the generally rectangular shape that is shown in the profile view of FIG. 1B. Moreover, this generally rectangular profile of the radome 110 may be parallel to the end caps 112, 120 of FIG. 1A. As shown in FIG. 1B, however, the profile of the perimeter wall 110W is not necessarily perfectly rectangular. Rather, the thick portions 110-C1, 110-C2, 110-C3, and 110-C4 may include respective interior surfaces, and/or respective exterior surfaces, that are curved. Similarly, the thick portions 110-F1, 110-F2, and 110-F3, which may be on the front side of the radome 110, may include respective interior surfaces, and/or respective exterior surfaces, that are curved, and the front surface may bulge outwardly.

Although FIG. 1B illustrates an example in which the perimeter wall 110W includes a plurality of thick portions 110-C/F, the perimeter wall 110W may, in some embodiments, include only one of the thick portions 110-C/F. For example, the perimeter wall 110W may be substantially uniform in thickness except for the thick portion 110-F2 that is on the front side/surface of the radome 110. Accordingly, the thick portions 110-C1, 110-C2, 110-C3, 110-C4, 110-F1, and 110-F3 may be omitted from the perimeter wall 110W. Alternatively, the thick portions 110-F1, 110-F2, and 110-F3 may be omitted from the perimeter wall 110W, such that the perimeter wall 110W is substantially uniform in thickness except for the thick portions 110-C1, 110-C2, 110-C3, and 110-C4.

Each of the thick portions 110-C/F of the perimeter wall 110W may improve the rigidity of the radome 110. This increased rigidity is due to the greater thickness of each thick portion 110-C/F relative to the thin portions 110-U of the perimeter wall 110W. As each thick portion 110-C/F may provide support to the structural integrity of the radome 110, the thick portions 110-C/F may be referred to herein as respective "supports." Moreover, as these supports 110-C/F may comprise rib/ridge shapes of the perimeter wall 110W, they may be referred to herein as "ribbed supports" or "support ridges."

Each of the supports 110-C/F may be built-in (e.g., non-detachable) portions of the perimeter wall 110W. Accordingly, the perimeter wall 110W may be a single monolithic part, rather than a plurality of individual/separate parts, that comprises the thin portions 110-U and at least one of the thick portions 110-C/F. In particular, the entirety of the non-uniformly thick perimeter wall 110W of the radome 110 may be formed as a unitary component, thus eliminating the need to snap together (or otherwise attach) the thin portions 110-U and the thick portion(s) 110-C/F to each other.

Also, each of the supports 110-C/F may be solid (rather than hollow) portions of the perimeter wall 110W. In particular, although the supports 110-C/F may, in some embodiments, comprise respective hollow-tube portions, it may be aesthetically desirable for the supports to instead be solid (i.e., free of such hollow-tube portions). For example, the supports 110-C/F may be built-in solid support ridges (e.g., built-in solid ribbed supports), respectively. Similarly, although the supports 110-C/F may, in some embodiments, protrude from the exterior surface 110W-E of the perimeter wall 110W, it may be aesthetically desirable for the supports 110-C/F to instead protrude from the interior surface 110W-I of the perimeter wall 110W toward a hollow region/cavity 110H inside the radome 110.

The thick portions 110-C/F of the perimeter wall 110W are not limited to a particular shape. In some embodiments, the thick portions 110-C1, 110-C2, 110-C3, and 110-C4 may have respective elliptical shapes (i.e., elliptical transverse cross-sections). Each of the elliptical shapes may have a radius of 25 mm or smaller in a direction that is perpendicular to the respective thickness (from the interior surface 110W-I to the exterior surface 110W-E) of the elliptical shape. As an alternative to an elliptical shape, one or more of the thick portions 110-C1, 110-C2, 110-C3, and 110-C4 may have a quadrilateral shape. An elliptical shape, however, may provide better performance than a quadrilateral shape, as the elliptical shape may increase the surface area of the interior surface 110W-I of the perimeter wall 110W and thus may provide increased structural support for the radome 110.

Radomes are typically made of fiberglass. A radome 110 according to embodiments of the present inventive concepts, however, may be a non-glass, non-metal radome. For example, the radome 110 may be a plastic radome, such as a PVC radome. In particular, the rigidity-enhancing thick portion(s) 110-C/F of the perimeter wall 110W may allow a PVC radome to perform substantially equivalently to a fiberglass radome, while maintaining desirable aesthetics and low weight and cost.

Figure 1C:
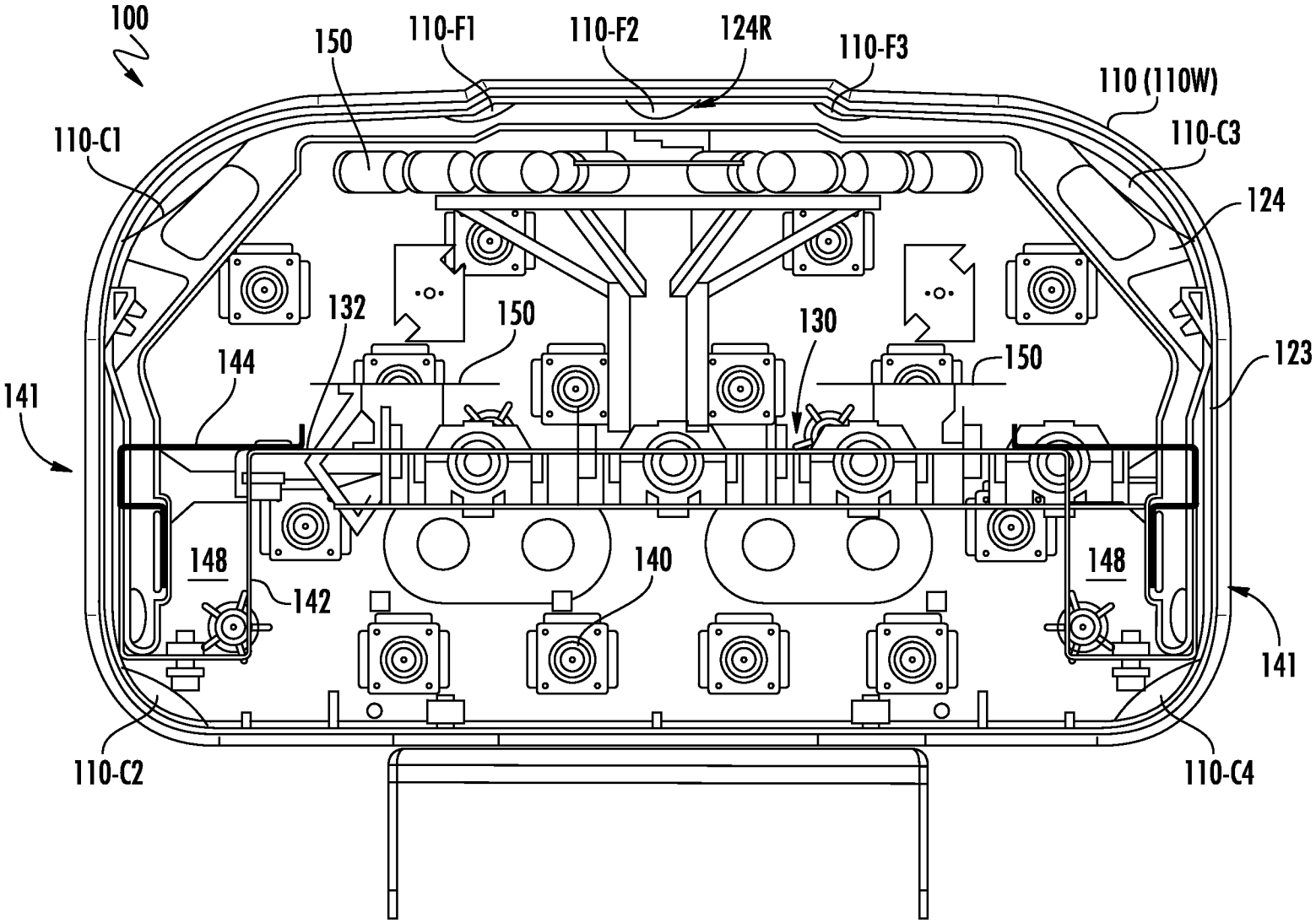
FIG. 1C is a profile view of a base station antenna including a radome support according to embodiments of the present inventive concepts.

FIG. 1C is a profile view of a base station antenna 100 including a radome support 124 according to embodiments of the present inventive concepts. Moreover, FIG. 1C illustrates that the base station antenna 100 may include a plurality of connectors 140, a radome 110, an antenna assembly 123, and radiating elements 150 (only three of which radiating elements 150 are visible in FIG. 1C). In some embodiments, the base station antenna 100 may further include a reflector assembly 130 having a main reflective surface 132 and a pair of integrated RF chokes 141 that each have a choke body 142 and a choke cover 144. A portion of the choke cover 144 extends into an interior 148 of the choke body 142.

The radome support 124 abuts an inner surface of the radome 110. For example, the radome support 124 may be a plastic radome support that abuts the interior surface 110W-I (FIG. 1B) of the perimeter wall 110W of the radome 110. In particular, the radome support 124 may include one or more recessed surfaces 1248 that fit/receive a respective one of the thick portions 110-C/F of the perimeter wall 110W. Accordingly, the radome support 124 may be shaped to conform to one or more ridge/rib shapes of the thick portion(s) 110-C/F of the perimeter wall 110W. Moreover, the perimeter wall 110W may wrap around the radiating elements 150, and at least one of the thick portions 110-C/F of the perimeter wall 110W may protrude toward the radiating elements 150.

Although only one radome support 124 is visible in FIG. 1C, the base station antenna 100 may include a plurality of radome supports 124. The radome supports 124 may comprise, for example, generally U-shaped plastic supports that have opposed arms that extend forwardly from the reflective surface 132 and a cross-bar that extends between the arms. The radome supports 124 may be spaced apart from each other along the length of the base station antenna 100. The radome supports 124 may act as a guide when the antenna assembly 123 is installed within the radome 110. In particular, the radome supports 124 may help ensure that the radome 110 does not contact elements of the antenna assembly 123 when the antenna assembly 123 is slid within the radome 110. The radome supports 124 may also protect elements of the base station antenna 100, such as the radiating elements 150, from deflection of the radome 110 during use under wind loading.

The non-uniformly thick perimeter wall 110W of the radome 110 according to embodiments of the present inventive concepts may provide a number of advantages. These advantages include strengthening the rigidity of the radome 110 by including at least one thick portion 110-C/F of the perimeter wall 110W in a relatively weak region, such as a corner and/or the front center, of the radome 110, while maintaining a relatively small weight and cost of the radome 110. For example, the majority of the perimeter wall 110W may be flat and have a thickness of 2.5 mm or thinner, and one or more relatively weak locations of the perimeter wall 110W may be strengthened by a respective thick portion 110-C/F. In embodiments in which the radome 110 is a plastic (e.g., PVC) radome, the strengthened rigidity provided by the thick portion(s) 110-C/F of the perimeter wall 110W may allow the plastic radome to perform substantially equivalently to a fiberglass radome.

Moreover, the advantages may include providing desirable aesthetics by using solid, rather than hollow, thick portion(s) 110-C/F and by locating the thick portion(s) 110-C/F on the interior surface 110W-I of the perimeter wall 110 rather than on the exterior surface 110W-E. Additionally or alternatively, the thick portion(s) 110-C/F may comprise respective elliptically-shaped ridges/ribbed supports, which may provide greater structural support than quadrilateral shapes that have smaller surface areas.

The present inventive concepts have been described above with reference to the accompanying drawings. The present inventive concepts are not limited to the illustrated embodiments. Rather, these embodiments are intended to fully and completely disclose the present inventive concepts to those skilled in this art. In the drawings, like numbers refer to like elements throughout. Thicknesses and dimensions of some components may be exaggerated for clarity.

Spatially relative terms, such as "under," "below," "lower," "over," "upper," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the example term "under" can encompass both an orientation of over and under. The device may be otherwise oriented (rotated 90 degrees or at other orientations) and the spatially relative descriptors used herein interpreted accordingly.

Herein, the terms "attached," "connected," "interconnected," "contacting," "mounted," and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the present inventive concepts. As used herein, the singular forms "a," "an," and "the" are intended to include the plural forms as well, unless the context clearly indicates otherwise. It will be further understood that the terms "comprises," "comprising," "includes," and/or "including" when used in this specification, specify the presence of stated features, operations, elements, and/or components, but do not preclude the presence or addition of one or more other features, operations, elements, components, and/or groups thereof.

That which is claimed is:

1. A base station antenna comprising:
a reflector;
a radiating element on the reflector; and
a radome comprising a non-uniformly thick perimeter wall around the radiating element, the non-uniformly thick perimeter wall comprising a protruding portion that is thicker than an adjacent flat portion of the non-uniformly thick perimeter wall,
wherein the protruding portion is spaced apart from the reflector,
wherein the protruding portion comprises one among a plurality of protruding portions of the non-uniformly thick perimeter wall, and
wherein the plurality of protruding portions comprise a plurality of built-in solid ribbed supports, respectively.

2. The base station antenna of claim 1, wherein the protruding portion protrudes toward the radiating element.

3. The base station antenna of claim 2, wherein the radome comprises a plastic radome.

4. The base station antenna of claim 1, further comprising a radome support that abuts an interior surface of the non-uniformly thick perimeter wall, the interior surface comprising the plurality of built-in solid ribbed supports.

5. The base station antenna of claim 4, wherein the radome support comprises a plurality of recessed portions that receive the built-in solid ribbed supports, respectively.

6. The base station antenna of claim 4, wherein the radome support is a plastic radome support.

7. The base station antenna of claim 1, wherein the radiating element comprises one among a plurality of radiating elements in the radome.

8. The base station antenna of claim 1,
wherein the radome comprises a plastic radome,
wherein the flat portion comprises a first thickness of 2.3-2.5 millimeters (mm), and
wherein the protruding portion comprises a second thickness of 5 mm or thinner that is thicker than the first thickness.

9. The base station antenna of claim 8, wherein the protruding portion comprises a transverse cross-section that comprises an elliptical shape comprising a radius of 25 mm or smaller that is perpendicular to the second thickness.

10. The base station antenna of claim 1, wherein the protruding portion has a thickness of 5 millimeters (mm) or thinner.

11. A radome of a base station antenna, the radome comprising:
a non-uniformly thick perimeter wall comprising:
first and second surfaces that face each other; and
third and fourth surfaces that face each other and that connect the first and second surfaces to each other,
wherein the non-uniformly thick perimeter wall increases in thickness at intersections of the third and fourth surfaces with the first and second surfaces,
wherein one of the first surface, the second surface, the third surface, or the fourth surface comprises a front surface of the radome, and wherein the non-uniformly thick perimeter wall increases in thickness at a midpoint of the front surface of the radome and at a point of the front surface of the radome that is between the midpoint and one of the intersections.

12. The radome of claim 11, wherein the intersections of the third and fourth surfaces with the first and second surfaces comprise respective curved portions of the non-uniformly thick perimeter wall.

13. The radome of claim 11, wherein the radome comprises a plastic radome, wherein flat portions of the first, second, third, and fourth surfaces comprise respective first thicknesses of 2.3-2.5 millimeters (mm), and wherein the intersections of the third and fourth surfaces with the first and second surfaces comprise respective second thicknesses of 5 mm or thinner that are thicker than the first thicknesses.

14. The radome of claim 13, wherein the intersections of the third and fourth surfaces with the first and second surfaces comprise respective elliptical shapes comprising radii of 25 mm or smaller that are perpendicular to the respective second thicknesses.

15. The radome of claim 11, wherein the intersections of the third and fourth surfaces with the first and second surfaces comprise respective thicknesses of 5 mm or thinner.

16. The radome of claim 11, wherein the intersections of the third and fourth surfaces with the first and second surfaces comprise four intersections at which the non-uniformly thick perimeter wall increases in thickness.

17. A base station antenna comprising:

a radiating element;

a radome comprising a non-uniformly thick perimeter wall around the radiating element, the non-uniformly thick perimeter wall comprising three protruding portions that are thicker than flat portions of the non-uniformly thick perimeter wall; and a plastic radome support that abuts an interior surface of the non-uniformly thick perimeter wall, the interior surface comprising the three protruding portions, wherein the three protruding portions have respective thicknesses of 5 millimeters (mm) or thinner.

18. The base station antenna of claim 17, wherein the flat portions comprise respective thicknesses of 2.3-2.5 mm.

19. The base station antenna of claim 17, wherein the non-uniformly thick perimeter wall further comprises fourth and fifth protruding portions having respective thicknesses of 5 mm or thinner.

* * * * *